US007438959B2

(12) United States Patent
Kometani et al.

(10) Patent No.: US 7,438,959 B2
(45) **Date of Patent: *Oct. 21, 2008**

(54) INTERMEDIATE TRANSFER RECORDING MEDIUM

(75) Inventors: Shinji Kometani, Tokyo-To (JP); Masayasu Yamazaki, Tokyo-To (JP); Masahiro Yuki, Tokyo-To (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 1111 days.

This patent is subject to a terminal disclaimer.

(21) Appl. No.: 10/264,322

(22) Filed: Oct. 4, 2002

(65) Prior Publication Data

US 2003/0117481 A1 Jun. 26, 2003

(30) Foreign Application Priority Data

Oct. 5, 2001 (JP) ..... 2001-309635
Nov. 27, 2001 (JP) ..... 2001-360342

(51) Int. Cl.
*B41M 5/40* (2006.01)

(52) U.S. Cl. ..... 428/32.51; 503/227

(58) Field of Classification Search ..... None
See application file for complete search history.

(56) References Cited

U.S. PATENT DOCUMENTS

| | | | | |
|---|---|---|---|---|
| 4,923,848 | A | 5/1990 | Akada et al. | 503/227 |
| 6,284,708 | B1 | 9/2001 | Oshima et al. | 503/227 |
| 6,855,473 | B2 * | 2/2005 | Odamura et al. | 430/200 |

FOREIGN PATENT DOCUMENTS

| | | | |
|---|---|---|---|
| EP | 1 188 570 | | 3/2002 |
| JP | A-08-002120 | | 1/1996 |
| JP | 2000-238439 | * | 9/2000 |

* cited by examiner

*Primary Examiner*—Bruce H Hess
(74) *Attorney, Agent, or Firm*—Oliff & Berridge, plc

(57) ABSTRACT

The present invention aims to solve a blocking problem of an intermediate transfer recording medium and to provide an intermediate transfer recording medium having excellent separability. The intermediate transfer recording medium comprises: a sheet substrate provided with a resin layer; and a transparent sheet provided with a receptive layer. The transparent sheet provided with the receptive layer has been put on top of the sheet substrate provided with the resin layer so that the resin layer faces the transparent sheet on its side remote from the receptive layer. The resin layer is separable from the transparent sheet to transfer the transparent sheet provided with the receptive layer onto an object. The resin layer has a single layer structure or a multilayer structure of two or more layers.

14 Claims, 6 Drawing Sheets

INTERMEDIATE TRANSFER RECORDING MEDIUM

TECHNICAL FIELD

The present invention relates to an intermediate transfer recording medium for the formation of an image on an object. More particularly, the present invention relates to an intermediate transfer recording medium which can be used to form an image on an object and, at that time, can form a protective layer on the image to impart fastness or resistance properties to the image, and permits the protective layer to be rapidly transferred onto the image with high accuracy, and a method for image formation using said intermediate transfer recording medium.

BACKGROUND OF THE INVENTION

Various thermal transfer recording methods have hitherto been known in the art. In these thermal transfer recording methods, a thermal transfer sheet comprising a color transfer layer provided on a substrate sheet is image wise heated from its backside, for example, by means of a thermal head to thermally transfer the color transfer layer onto the surface of a thermal transfer image-receiving sheet, thereby forming an image.

The thermal transfer methods are roughly classified according to the construction of the color transfer layer into two methods, i.e., thermal dye sublimation transfer (sublimation-type thermal transfer) and thermal ink transfer (heat-fusion transfer). For both the methods, full-color images can be formed. For example, a thermal transfer sheet comprising colorant layers of three colors of yellow, magenta, and cyan or optionally four colors of yellow, magenta, cyan, and black is provided, and images of the individual colors are thermally transferred in a superimposition manner on the surface of an identical thermal transfer image-receiving sheet to form a full-color image.

The development of various hardwires and softwares associated with multimedia has led to the expansion of the market of the thermal transfer method as a full-color hard copy system for computer graphics, static images through satellite communication, digital images typified, for example, by images of CD-ROMs (compact disc read only memory), and analog images, such as video images.

Specific applications of the thermal transfer image-receiving sheet used in the thermal transfer method are various, and representative examples thereof include proofs of printing, output of images, output of plans and designs, for example, in CAD/CAM, output of various medical analytical instruments and measuring instruments, such as CT scans and endoscope cameras, alternative to instant photographs, output and printing of photograph-like images of a face or the like onto identification cards or ID cards, credit cards, and other cards, and composite photographs and commemorative photographs, for example, in amusement facilities, such as amusement parks, game centers (amusement arcades), museums, and aquaria.

The diversification of the applications has led to an increasing demand for the formation of a thermally transferred image on a desired object. One method proposed for meeting this demand comprises the steps of: providing an intermediate transfer recording medium comprising a substrate and a receptive layer separable provided on the substrate; providing a thermal transfer sheet having a dye layer; transferring the dye from the thermal transfer sheet to the receptive layer in the intermediate transfer recording medium to form a dye image on the receptive layer; and then heating the intermediate transfer recording medium to transfer the receptive layer with the image formed thereon onto an object (see Japanese Patent Laid-Open No. 238791/1987).

Sublimation transfer-type thermal transfer sheets can faithfully form gradational images, such as photograph-like images of a face. Unlike conventional images produced by printing inks, however, these images are disadvantageously unsatisfactory in durability (fastness or resistance properties), such as weathering resistance, abrasion resistance, and chemical resistance.

To solve this problem, a method has been proposed wherein a protective layer thermal transfer film having a thermally transferable resin layer is put on top of a thermally transferred image and the transparent thermally transferable resin layer is transferred, for example, by means of a thermal head or heating roll to form a protective layer on the image.

Further, Japanese Patent Application No. 41441/1999 describes a highly durable intermediate transfer recording medium comprising a receptive layer provided on a separable transparent substrate. In this intermediate transfer recording medium, after the formation of an image in the receptive layer, the receptive layer with the image formed thereon, together with the transparent substrate, is brought into contact with an object so that the image surface faces the object to transfer the image onto the object.

These conventional intermediate transfer recording media are useful from the viewpoint of improving the durability, but on the other hand, at the present time, the problem inherent in the use of the intermediate transfer recording medium has not been solved.

Specifically, the intermediate transfer recording medium is in many cases used in a roll form. In this case, a problem of blocking sometimes occurs between the sheet substrate side and the transparent sheet side in the medium. In particular, in the intermediate transfer recording medium wherein the transparent sheet portion including the receptive layer has been half cut, the image non-forming portion is removed from the half cut portion. When the intermediate transfer recording medium with the image non-forming portion removed there from is wound into a roll, blocking is likely to occur between the sheet substrate side and the transparent sheet side. This sometimes makes it difficult to rewind the roll. Further, in this intermediate transfer recording medium, since printing is carried out in a wider area than the area to be actually retransferred onto the object, the uppermost surface of the resin layer formed on the sheet substrate should be separable from the thermal transfer sheet.

In view of the problems of the prior art, the first aspect of the present invention has been made, and an object of the present invention is to provide an intermediate transfer recording medium which is free from the problem of blocking, is excellent in reparability at the time of rewinding of the roll, and has excellent reparability from the thermal transfer sheet at the time of printing.

Incidentally, the above protective layer should be partially transferred at the time of transfer by means of a thermal head or a hot roll and thus should be transferable. To this end, the protective layer should be a resin layer having a thickness of about several μm. This makes it impossible to impart fastness or resistance properties, such as high scratch resistance and chemical resistance, to images. Also for the protective layer formed in the intermediate transfer recording medium, satisfactory fastness or resistance properties, such as satisfactory scratch resistance and chemical resistance, cannot be imparted from the viewpoint of transferability. The formation of an image on an object using an intermediate transfer recording medium followed by lamination of a resin film onto the image on the object so as to cover the image is considered effective for the formation of the protective layer. In this method, however, when the object has a certain shape, cockling is likely to occur in the resin film upon the lamination. Further, the provision of an additional step such as treatment by a special device such as a laminator is necessary.

Japanese Patent Laid-Open No. 238439/2000 as a prior art technique discloses an intermediate transfer recording medium comprising: a support provided with a resin layer; and a transparent sheet provided with a receptive layer, the support provided with a resin layer having been stacked onto the transparent sheet provided with a receptive layer so that the resin layer is separable from the transparent sheet, the transparent sheet portion including the receptive layer having been half cut. The resin layer is a pressure-sensitive adhesive layer formed of a vinyl acetate resin, an acrylic resin or the like, an easy-adhesion layer formed of SBR, NBR or the like, or an EC layer formed of an extricable reins such as LDPE.

This prior art technique would suffer from the following problems.

1. Change in peel force with elapse of time: In the case of the material for the pressure-sensitive adhesive layer and the material for the easy-adhesion layer as the resin layer, the peel force between the resin layer and the transparent sheet is likely to increase with the elapse of time.
2. Lack of stable separation at the time of transfer: In the transfer of the transparent sheet from the intermediate transfer recording medium onto the object by means of a heat roll or the like with heating at about 100 to 200° C., the transparent sheet in the intermediate transfer recording medium cannot be stably separated.
3. Lack of reliability of the intermediate transfer recording medium from the thermal transfer sheet at the time of image formation: When the image to be formed on the receptive layer has been unfavorably off to the resin layer, or when an image, which is somewhat larger than the transparent sheet provided with the receptive layer, is printed for the formation of the image on the whole area of the intermediate transfer recording medium, fusing occurs between the thermal transfer sheet and the resin layer, resulting in breaking of the thermal transfer sheet.

Accordingly, in a second aspect, an object of the present invention is to solve the above problems of the prior art and to provide an intermediate transfer recording medium, which can be used to form an image on an object, can form a protective layer on the image to fully impart fastness or resistance properties to the image, permits the protective layer to be transferred onto the image with high accuracy in a simple manner, and can realize stable release from a thermal transfer sheet at the time of image formation and stable separation from an object at the time of transfer onto an object.

DISCLOSURE OF THE INVENTION

First Invention

The above object of the first invention can be solved by an intermediate transfer recording medium comprising: a sheet substrate provided with a resin layer; and a transparent sheet provided with a receptive layer, said transparent sheet provided with the receptive layer having been put on top of the sheet substrate provided with the resin layer so that the resin layer faces the transparent sheet on its side remote from the receptive layer, the resin layer being separable from the transparent sheet to transfer the transparent sheet provided with the receptive layer onto an object, said resin layer having a single layer structure or a multilayer structure of two or more layers.

In a preferred embodiment of the intermediate transfer recording medium according to the present invention, the resin layer is formed of a polyolefin resin stacked on the sheet substrate by extrusion coating. More preferably, the polyolefin resin is low density polyethylene.

In the preferred embodiment of the present invention, the lower side temperature of a die at the time of extrusion of the low density polyethylene may be properly selected depending upon the device used. In general, however, the lower side temperature of the die is preferably 300 to 310° C. or below, more preferably 295° C. or below.

In another preferred embodiment of the present invention, the polyolefin resin is medium density polyethylene.

In a further preferred embodiment of the present invention, the resin layer has a two-layer structure of a first resin layer and a second resin layer provided in that order from the transparent sheet side and the first resin layer is composed mainly of an acrylic resin. In this case, the second resin layer is preferably an adhesive layer.

In a still further preferred embodiment of the present invention, the resin layer has a three-layer structure of a first resin layer, a second resin layer, and a third resin layer provided in that order.

In another embodiment of the present invention, the transparent sheet portion including the receptive layer may be half cut.

In this case, the image non-forming portion in the transparent sheet including the receptive layer, which has been subjected to half cutting, may be previously removed.

The present invention includes a printing method comprising the step of, in using the above intermediate transfer recording medium, printing an image in an area larger than a patch portion as the image forming portion.

Thus, in the intermediate transfer recording medium according to the present invention, a sheet substrate provided with a resin layer has been stacked onto a transparent sheet provided with a receptive layer so that the resin layer faces the transparent sheet on its side remote from the receptive layer. The resin layer is separable from the transparent sheet to transfer the transparent sheet provided with the receptive layer onto an object. The resin layer has a single layer structure or a multilayer structure of two or more layers. In particular, when the resin layer is formed of a polyolefin resin stacked on the sheet substrate by extrusion coating, even in the use of the intermediate transfer recording medium in a roll form, the problem of blocking does not occur. Further, the reparability at the time of rewinding of the roll is excellent, and the reparability of the intermediate transfer recording medium from the thermal transfer sheet at the time of printing is excellent.

Second Invention

The second aspect of the present invention is directed to the solution of the above problems of the prior art and provides an intermediate transfer recording medium comprising: a support; and a transparent sheet stacked on the support through a resin layer, said transparent sheet comprising at least a transparent substrate and a receptive layer, the resin layer being separable from the transparent substrate, the resin layer comprising a polyallylate resin.

The polyallylate resin preferably comprises a polycondensate of a biphenyl component of 1,1-bis(4-hydroxyphenyl)-1-phenyl ethane with an aromatic dicarboxylic acid component. In this case, the glass transition temperature is improved to enhance the heat resistance, and, in addition, the solubility in general-purpose solvents can be increased to eliminate the need to use or handle highly harmful solvents, such as chlorinated hydrocarbon solvents, for coating of the resin layer and to provide safe work environment.

In the present invention, preferably, an intermediate layer is provided between the support and the resin layer. This can enhance the adhesion between the support and the resin layer.

The peel force between the resin layer and the transparent substrate is preferably 0.01 to 0.5 N/inch. The peel force between the resin layer and the transparent substrate is more preferably 0.03 to 0.2 N/inch. This can provide excellent transferability of the transparent sheet onto the object and can fully prevent abnormal transfer between the intermediate transfer recording medium and the thermal transfer sheet at the time of image formation.

In a preferred embodiment of the present invention, a filler is incorporated into the resin layer. This can realize more stable release of the intermediate transfer recording medium from the thermal transfer sheet at the time of image formation and more stable separation of the intermediate transfer recording medium from the object at the time of transfer onto the object.

Further, preferably, the transparent sheet portion comprising at least the transparent substrate and the receptive layer has been half cut. In this case, in the retransfer of the image from the intermediate transfer recording medium onto an object, the image can be surely transferred onto the object because the transparent sheet has been cut in the half cut portion.

BEST MODE FOR CARRYING OUT THE INVENTION

First Invention

The intermediate transfer recording medium according to the first invention comprises: a sheet substrate provided with a resin layer; and a transparent sheet provided with a receptive layer, said transparent sheet provided with the receptive layer having been put on top of the sheet substrate provided with the resin layer so that the resin layer faces the transparent sheet on its side remote from the receptive layer, the resin layer being separable from the transparent sheet to transfer the transparent sheet provided with the receptive layer onto an object, said resin layer having a single layer structure or a multilayer structure of two or more layers.

Figure 1:
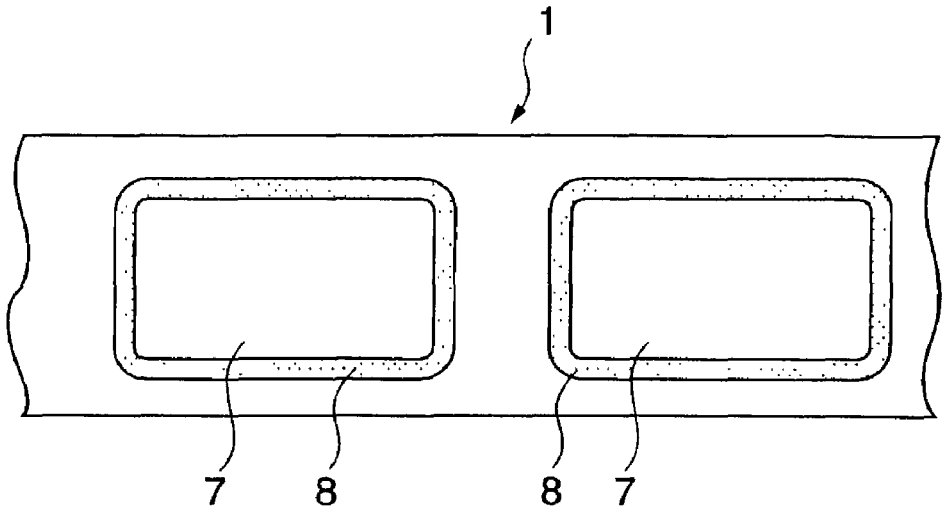
FIG. 1 is a plan view showing an embodiment of the intermediate transfer recording medium according to the present invention.

FIG. 1 is a plan view showing an embodiment of the intermediate transfer recording medium according to the present invention. A continuous intermediate transfer recording medium 1 has a rectangular region 7 having rounded four corners to be transferred onto an object, and a portion 8, where the transparent sheet provided with the receptive layer has been removed in a predetermined width, is present around the outer periphery of the region 7. The region 7 and the removed portion 8 are repeatedly provided in the direction of flow.

Figure 2:
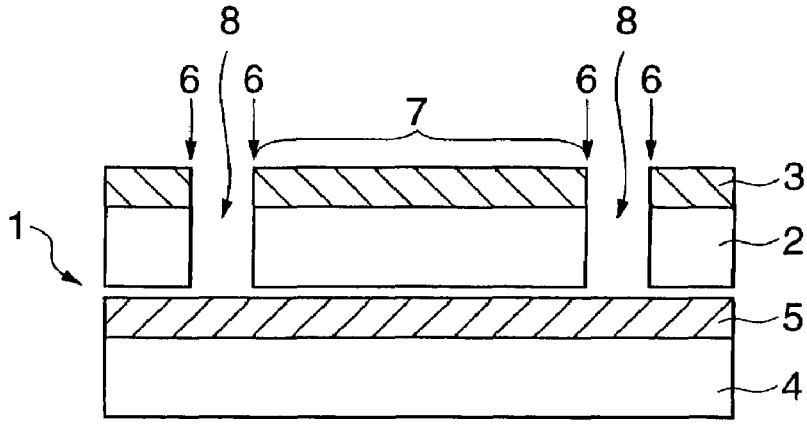
FIG. 2 is a cross-sectional view of the intermediate transfer recording medium shown in FIG. 1.

FIG. 2 is a schematic cross-sectional view of a position indicated by an arrow in FIG. 1. In the intermediate transfer recording medium 1, a sheet substrate 4 provided with a resin layer 5 is stacked onto a transparent sheet 2 provided with a receptive layer 3 so that the resin layer 5 faces the transparent sheet 2 on its side remote from the receptive layer 3. The resin layer 5 being separable from the transparent sheet 2 to transfer the transparent sheet 2 provided with a receptive layer 3 onto an object. The transparent sheet 2 portion including the receptive layer 3 has been subjected to half cutting 6 in a specific shape and in a predetermined width around the outer periphery of the region 7, to be transferred onto the object, to provide a removed portion 8.

Figure 3:
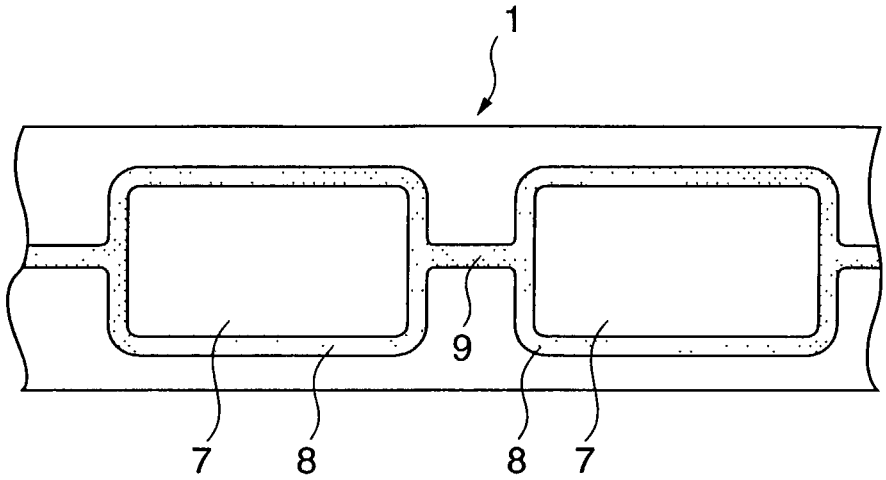
FIG. 3 is a plan view showing another embodiment of the intermediate transfer recording medium according to the present invention.
Figure 4:
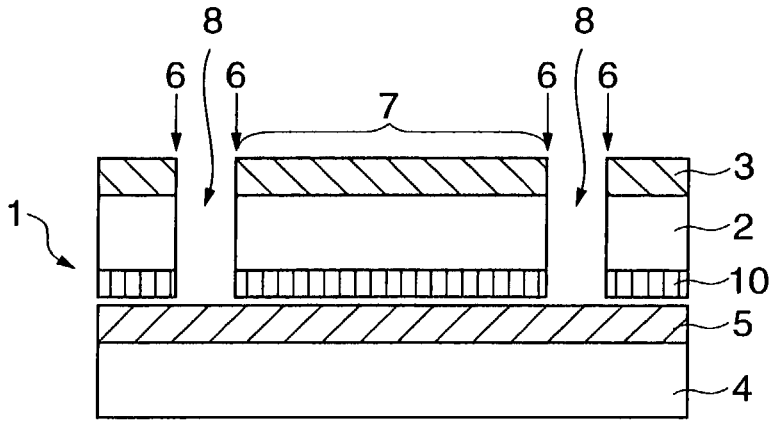
FIG. 4 is a cross-sectional view showing a further embodiment of the intermediate transfer recording medium according to the present invention.

FIG. 3 is a plan view showing another embodiment of the intermediate transfer recording medium according to the present invention. According to this embodiment, in a continuous intermediate transfer recording medium 1, a rectangular region 7 having four rounded corners to be transferred onto an object is repeatedly provided in the direction of flow, and a portion 8, where the transparent sheet provided with the receptive layer has been removed in a predetermined width, is present around the outer periphery of the region 7. Further, adjacent removed portions 8 are continuously connected to each other through a connection 9 in the direction of flow. By virtue of this, refuse generated in the removal of the non-transfer region in a predetermined width in the outer periphery of the region to be transferred can be continuously removed with high efficiency. FIG. 4 is a cross-sectional view showing a further embodiment of the intermediate transfer recording medium according to the present invention. This intermediate transfer recording medium 1 comprises: a sheet substrate 4 provided with a resin layer 5; and a transparent sheet 2 having a receptive layer 3 on its one side with the other side having been subjected to release treatment 10, the sheet substrate 4 provided with the resin layer 5 having been put on top of the transparent sheet 2 provided with the receptive layer 3 so that the resin layer 5 faces the surface subjected to the release treatment 10, the resin layer 5 being separable from the surface subjected to the release treatment 10. The transparent sheet 2 portion including the receptive layer 3 and the portion subjected to the release treatment 10 has been subjected to half cutting 6 in a predetermined width around the outer periphery of a region 7, to be transferred onto an object, to provide a removed portion indicated by numeral 8.

Figure 5:
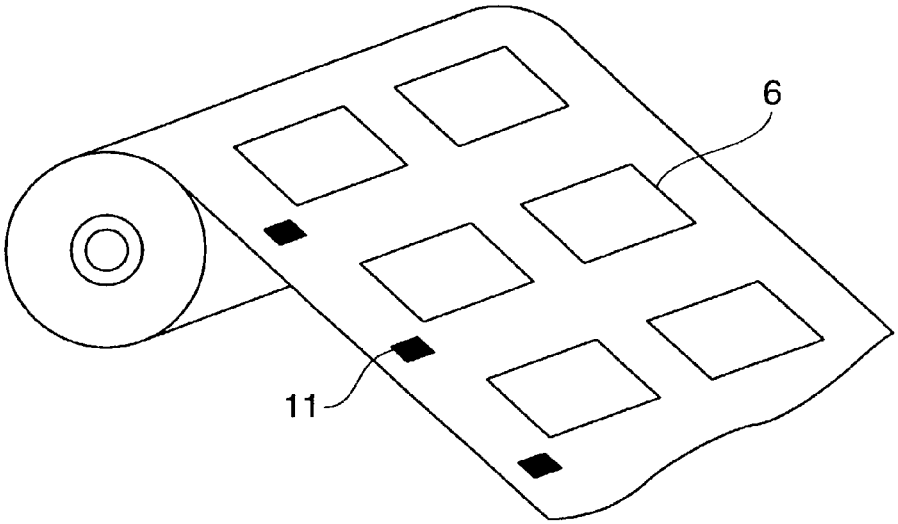
FIG. 5 is a schematic perspective view showing an embodiment of the intermediate transfer recording medium according to the present invention wherein the intermediate transfer recording medium is in a continuous roll form.

FIG. 5 is a schematic perspective view showing an embodiment of the intermediate transfer recording medium of the present invention wherein the intermediate transfer recording medium is in a continuous roll form. In this intermediate transfer recording medium, identification marks 11 for detecting the half cuts 6 are provided. The identification marks can be detected to transfer the transparent sheet, provided with the receptive layer with an image formed thereon, onto an object and, in addition, to form an image on the receptive layer in its predetermined position. Detection marks for image formation can also be provided separately from the identification marks.

(Transparent Sheet)

In the transparent sheet 2 in the intermediate transfer recording medium according to the present invention, the transparent sheet portion is cut using the half cut portion as the boundary between the removal portion and the portion remaining unresolved, and, after the transfer, the transparent sheet covers the surface of the image formed portion and functions as a protective layer.

The transparent sheet is not particularly limited so far as the sheet is transparent and has fastness or resistance properties, such as weathering resistance, abrasion resistance, and chemical resistance. Examples of transparent sheets usable herein include about 0.5 to 100 μm-thick, preferably about 10 to 40 μm-thick, films of polyethylene terephthalate, 1,4-polycyclohexylene dim ethylene terephthalate, polyethylene naphtha late, polyphenylene sulfide, polystyrene, polypropylene, polysulfide, agamid, polycarbonate, polyvinyl alcohol, cellulose derivatives, such as cellophane and cellulose acetate, polyethylene, polyvinyl chloride, nylon, polyimide, and monomer.

(Release Treatment)

The transparent sheet in its side facing the resin layer may be subjected to release treatment 10 to facilitate the separation of the transparent sheet from the resin layer.

In the release treatment 10, a release layer is provided on the transparent sheet. The release layer may be formed by coating a coating liquid containing, for example, a wax, silicone wax, a silicone resin, a fluororesin, an acrylic resin, a polyvinyl alcohol resin, or a cellulose derivative resin or a copolymer of monomers constituting the above group of resins onto the transparent sheet by conventional means, such as gravure printing, screen printing, or reverse roll coating using a gravure plate, and drying the coating.

The thickness of the release layer is about 0.1 to 10 μm on a dry basis.

(Receptive Layer)

The receptive layer 3 may be formed on the transparent sheet either directly or through a primer layer. The construction of the receptive layer 3 varies depending upon the recording system, that is, whether the recording system is hot-melt transfer recording or sublimation transfer recording. In the hot-melt transfer recording, a method may also be adopted wherein a color transfer layer is thermally transferred from the thermal transfer sheet directly onto the transparent sheet without providing the receptive layer. In the hot-melt transfer recording and the sublimation transfer recording, the receptive layer functions to receive a colorant thermally transferred from the thermal transfer sheet. In particular, in the case of the sublimely dye, preferably, the receptive layer receives the dye, develops a color, and, at the same time, does not permit republication of the once received dye.

A transfer image is formed on a receptive layer in an intermediate transfer recording medium, and only the image formed portion is retransferred onto an object to form an image on the object. The receptive layer according to the present invention is generally transparent so that an image transferred onto the object can be clearly viewed from the top. However, it is also possible to intentionally make the receptive layer opaque or to intentionally lightly color the receptive layer to render the re-transferred image distinct.

The receptive layer is generally composed mainly of a thermoplastic resin. Examples of materials usable for forming the receptive layer include: polyolefin resins such as polypropylene; halogenated polymers such as vinyl chloride-vinyl acetate copolymer, ethylene-vinyl acetate copolymer, and polyvinylidene chloride; polyester resins such as polyvinyl acetate and polycyclic esters; polystyrene resins; polyamide resins; copolymer resins produced from olefins, such as ethylene and propylene, and other vinyl monomers; monomers; cellulosic resins such as cellulose dictate; and polycarbonate resins. Among them, polyester resins and vinyl chloride-vinyl acetate copolymer and mixtures of these resins are particularly preferred.

In sublimation transfer recording, a release agent may be incorporated into the receptive layer, for example, from the viewpoint of preventing fusing between the thermal transfer sheet having a color transfer layer and the receptive layer in the intermediate transfer recording medium at the time of image formation or preventing a lowering in sensitivity in printing. Preferred release agents usable as a mixture include silicone oils, phosphoric ester surfactants, and fluorosurfactants. Among them, silicone oils are preferred. Preferred silicone oils include epoxy-modified, vinyl-modified, alkyl-modified, amino-modified, carboxyl-modified, alcohol-modified, fluorine-modified, alkyl a alkyl polyether-modified, epoxy-polyether-modified, polyether-modified and other modified silicone oils.

A single or plurality of release agents may be used. The amount of the release agent added is preferably 0.5 to 30 parts by weight based on 100 parts by weight of the resin for the receptive layer. When the amount of the release agent added is outside the above amount range, problems sometimes occur such as fusing between the sublimation-type thermal transfer sheet and the receptive layer in the intermediate transfer recording medium or a lowering in sensitivity in printing. The addition of the release agent to the receptive layer permits the release agent to bleed out on the surface of the receptive layer after the transfer to form a release layer. Alternatively, these release agents may be separately coated onto the receptive layer without being incorporated into the receptive layer.

The receptive layer may be formed by coating a solution of a mixture of the above resin with a necessary additive, such as a release agent, in a suitable organic solvent, or a dispersion of the mixture in an organic solvent or water onto a transparent sheet by conventional forming means such as gravure coating, gravure reverse coating, or roll coating, and drying the coating.

The receptive layer may be formed in any thickness. In general, however, the thickness of the receptive layer is 1 to 50 μm on a dry basis.

The receptive layer is preferably in the form of a continuous coating. However, the receptive layer may be in the form of a discontinuous coating formed using a resin emulsion, a water-soluble resin, or a resin dispersion. Further, an antistatic agent may be coated onto the receptive layer from the viewpoint of realizing stable carrying of sheets through a thermal transfer printer.

(Sheet Substrate)

The sheet substrate 4 used in the present invention is not particularly limited, and examples thereof include: various types of paper, for example, capacitor paper, glassine paper, parchment paper, or paper having a high sizing degree, synthetic paper (such as polyolefin synthetic paper and polystyrene synthetic paper), cellulose fiber paper, such as wood free paper, art paper, coated paper, cast coated paper, wall paper, backing paper, synthetic resin- or emulsion-impregnated paper, synthetic rubber latex-impregnated paper, paper with synthetic resin internally added thereto, and paperboard; and films of polyester, polyacrylate, polycarbonate, polyurethane, polyimide, polyether imides, cellulose derivative, polyethylene, ethylene-vinyl acetate copolymer, polypropylene, polystyrene, acrylic resin, polyvinyl chloride, polyvinylidene chloride, polyvinyl alcohol, polyvinyl butyric, nylon, polyether ether ketene, polysulfide, polyether sulfide, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like.

The thickness of the sheet substrate is preferably 10 to 100 μm. When the sheet substrate is excessively thin, the resultant intermediate transfer recording medium is not sturdy and thus cannot be carried by means of a thermal transfer printer or is disadvantageously curled or cockled. On the other hand, when the sheet substrate is excessively thick, the resultant intermediate transfer recording medium is excessively thick. In this case, the driving force of the thermal transfer printer necessary for carrying the intermediate transfer recording medium is excessively large, resulting in a printer trouble or a failure of the intermediate transfer recording medium to be normally carried.

(Resin Layer)

In the present invention, the resin layer 5 provided on the sheet substrate has a single-layer structure or a multilayer structure of two or more layers.

In a preferred embodiment of the intermediate transfer recording medium according to the present invention, the resin layer is formed of a polyolefin resin stacked on the sheet substrate by extrusion coating. More preferably, the polyolefin resin is low density polyethylene.

Here in the present invention, "extrusion coating" refers to a coating method which involves the step of feeding resin pellets or resin powder from a hopper and, while heating the resin and mixing/kneading the resin by means of a screw, extruding the resin through a T die into a film which is stacked onto a sheet substrate. Further, this method includes an embodiment wherein the resin is extruded into between two sheet substrates to mutually laminate the two sheet substrates onto each other.

Further, in the present invention, the low density polyethylene, which is preferably used in the present invention, refers to a polyethylene having a density of not more than 0.93 g/cm$^3$. The lower side temperature of a die at the time of extrusion of the low density polyethylene may be properly selected according to the apparatus used. In general, however, the lower side temperature of the die is preferably 300 to 310° C. or below, more preferably 295° C. or below.

In another preferred embodiment of the present invention, the polyolefin resin is medium density polyethylene. In this case, the medium density polyethylene refers to a polyethylene having a density of 0.93 to 0.94 g/cm$^3$.

In a further preferred embodiment of the present invention, the resin layer has a two-layer structure of a first resin layer and a second resin layer provided in that order as viewed from the transparent sheet side, and the first resin layer is composed mainly of an acrylic resin. In this embodiment, the second resin layer is preferably an adhesive layer.

In a still further preferred embodiment of the present invention, the resin layer has a three-layer structure of a first resin layer, a second resin layer, and a third resin layer provided in that order.

As described above, in the present invention, an EC layer (a layer formed by extrusion coating) may be provided as a resin layer on the sheet substrate. The thermoplastic resin used for forming the EC layer is not particularly limited so far as the resin is not virtually adhered to the transparent sheet and is extricable. In particular, however, a polyolefin resin is preferred which is not virtually adhered to PET films generally utilized in the transparent sheet and has excellent process ability. More specifically, in addition to the above-described LDPE and MDPE resins, for example, HDPE and PP resins are also usable. In the extrusion coating of these resins, when a matte roll is used as a cooling roll, the matte face may be transferred onto the surface of the EC layer, whereby fine concaves and convexes can be formed to render the EC layer opaque.

Alternatively, a method may be used wherein a white pigment, such as calcium carbonate or titanium oxide, is mixed into the polyolefin resin to form an opaque EC layer.

The EC layer may be either a single-layer structure or a multilayer structure of two or more layers.

The peel strength of the EC layer from the transparent sheet may be regulated according to the processing temperature in the extrusion and the type of the resin.

Thus, simultaneously with the extrusion of the EC layer on the sheet substrate, the sheet substrate can be stacked onto the transparent sheet through the EC layer by the so-called "EC lamination."

(Primer Layer)

In providing the resin layer on the sheet substrate, a primer layer may be provided on the surface of the sheet substrate to improve the adhesion between the sheet substrate and the resin layer. Instead of the provision of the primer layer, the surface of the sheet substrate may be subjected to corona discharge treatment, or alternatively the surface of the EC layer on its sheet substrate side may be subjected to ozone treatment.

The primer layer may be formed by providing a coating liquid in the form of a solution or dispersion of a polyester resin, a polycyclic ester resin, a polyvinyl acetate resin, a polyurethane resin, a polyamide resin, a polyethylene resin, a polypropylene resin or the like in a solvent and coating the coating liquid by the same means as used in the formation of the receptive layer.

The thickness of the primer layer is about 0.1 to 5 μm on a dry basis.

The primer layer may also be formed between the transparent sheet and the receptive layer in the same manner as described above.

A suitable slip layer (not shown) may be provided on the sheet substrate in its side remote from the resin layer, for example, from the viewpoint of improving variability at the time of sheet feeding in the thermal transfer printer. The slip layer may be formed of a single resin or a blend of two or more resins selected from conventional resins, such as butyric resins, polycyclic esters, polymethacrylic esters, polyvinylidene chloride, polyesters, polyurethane, polycarbonate, and polyvinyl acetate, a lubricant, such as various fine particles or silicone, having been added to the single resin or the resin blend.

The intermediate transfer recording medium according to the present invention has a construction such that at least a receptive layer, a transparent sheet, a resin layer, and a sheet substrate are stacked in that order on top of one another and the resin layer is separable applied to the transparent sheet. An antistatic layer may be provided on the surface of the receptive layer, the backside of the sheet substrate, or the outermost surface of both sides. The antistatic layer may be formed by coating a solution or dispersion of an antistatic agent, such as a fatty ester, a sulfuric ester, a phosphoric ester, an amide, a quaternary ammonium salt, a beanie, an amino acid, an acrylic resin, or an ethylene oxide adduct, in a solvent. The forming means used may be the same as that used in the formation of the receptive layer. The coverage of the antistatic layer is preferably 0.001 to 0.1 g/m$^2$ on a dry basis.

An intermediate layer formed of one of various resins may be provided between the substrate and the receptive layer in the transparent sheet. In this case, the intermediate layer is preferably transparent so that the re-transferred image can be viewed.

When the intermediate layer has various functions, excellent functions can be imparted to the image-receiving sheet. For example, a highly elastically deformable or plastically deformable resin, for example, a polyolefin resin, a vinyl copolymer resin, a polyurethane resin, or a polyamide resin, may be used as a cushioning property-imparting resin to improve the sensitivity in printing of the image-receiving sheet or to prevent harshness of images.

Further, if necessary, the intermediate layer may contain antistatic agents, ultraviolet absorbers, and fluorescent dyes. For example, an ultraviolet absorber may be added to the intermediate layer from the viewpoint of improving the light fastness of the image. Ultraviolet absorbers usable herein include low-molecular weight compounds having a melting point of 50 to 150° C., for example, benzophenone, benzotriazole, cyanoacrylate, calculate, and oxalanilide compounds. Further, a fluorescent dye may be added to the intermediate layer from the viewpoint of imparting security. Fluorescent dyes usable herein include, for example, europium compounds. Specifically, europium complex compounds, such as n-tetrabutylammonium salt of europium complex of tetra[4,4,4-trifluoro-1-(2-thienyl)-1,3-butanedionate], are preferred.

(Half Cutting)

In the intermediate transfer recording medium according to the present invention, the transparent sheet portion including the receptive layer has been subjected to half cutting 6. The half cut may be formed by any method without particular limitation so far as half cutting is possible. Examples of methods usable for half cutting include a method wherein the intermediate transfer recording medium is inserted into between an upper die, provided with a cutter blade, and a pedestal and the upper die is then vertically moved, a method wherein a cylinder-type rotary cutter is used, and a method wherein heat treatment is carried out by means of a laser beam.

Figure 6:
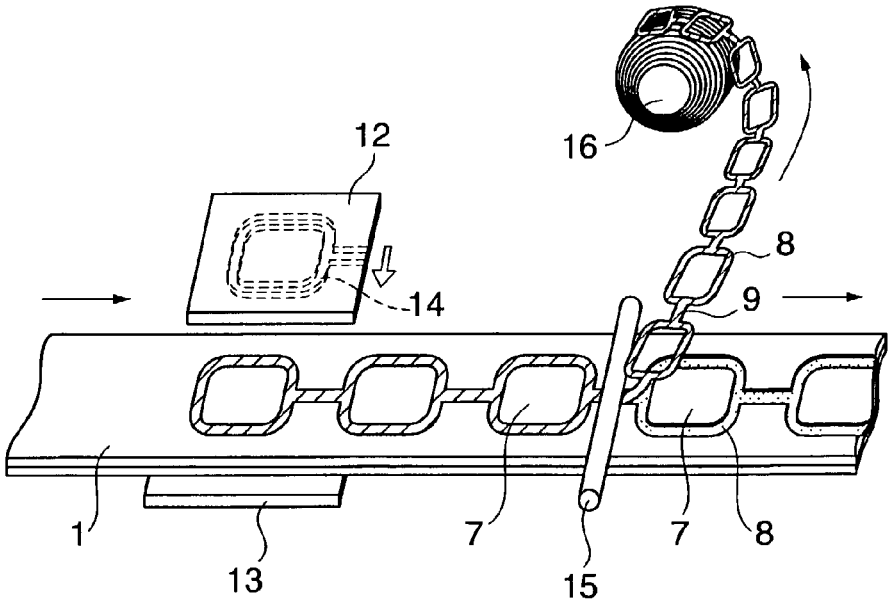
FIG. 6 is a schematic view illustrating an embodiment of half cutting of the intermediate transfer recording medium according to the present invention.

FIG. 6 is a schematic view illustrating an embodiment of half cutting of the intermediate transfer recording medium according to the present invention. At the outset, the intermediate transfer recording medium 1 composed of the sheet substrate provided with the resin layer and, stacked onto the resin layer, the transparent sheet provided with the receptive layer is fed into between an upper die 12, provided with a cutter blade 14, and a pedestal 13, and the upper die 12 is then moved downward to cut the transparent sheet provided with the receptive layer by means of the cutter blade 14 in the intermediate transfer recording medium 1. In the embodiment shown in the drawing, the region 7 to be transferred onto one unit of object is subjected to half cutting, the adjacent region is then subjected to half cutting, and this procedure is repeated to perform continuous half cutting. In this connection, it should be noted that a plurality of units of the region 7 may be simultaneously subjected to half cutting.

In the intermediate transfer recording medium 1 subjected to half cutting, refuse is then continuously removed from the transparent sheet provided with the receptive layer by means of a separation roll 15 in such a state that a portion (8) around the outer periphery of the region 7 to be transferred onto the object is connected to a connection 9. The refuse is wound by means of a refuse removing roll 16.

Thus, in the intermediate transfer recording medium 1, in the step of removing of refuse, the transparent sheet provided with the receptive layer is removed in the portion 8 around the outer periphery of the region 7 to be transferred onto the object and the connection 9, whereby the intermediate transfer recording medium 1 specified in the present invention is prepared.

As shown in FIG. 1, when only the transparent sheet side in its portion around the outer periphery of the region 7 to be transferred onto an object is removed (that is, when no connection is provided), continuous removal of the refuse as described above is impossible. In this case, for example, the refuse may be removed by a specialty refuse removing tool of vacuum type, tack type or other type which has a size slightly smaller than the size of the portion to be removed on the transparent sheet side.

Thus, in the intermediate transfer recording medium according to the present invention, the provision of a portion subjected to half cutting in a specific shape in the transparent sheet portion including the receptive layer, that is, a portion, from which the transparent sheet provided with the receptive layer has been removed in a predetermined width, around the outer periphery of the region to be transferred onto the object, is advantageous in that, even when the resin layer in contact with the transparent sheet is exposed, since the resin layer is partially exposed, that is, since the unexposed portion is larger than the exposed portion (the exposed portion is surrounded by the unexposed portion), there is no fear of blocking or the like occurring in the exposed portion.

Further, in the intermediate transfer recording medium according to the present invention, the transparent sheet provided with the receptive layer has been removed in a predetermined width in a portion around the outer periphery of the region to be transferred onto the object. Therefore, even when the printing position is slightly deviated from the contemplated position at the time of image formation, printing is made on only the region to be transferred onto the object and the image is not formed at an unnecessary position. Further, in retransferring the transparent sheet side, with an image formed thereon, onto the object, even when the positional accuracy in the retransfer is not very high (that is, even when the retransfer position is somewhat deviated from the contemplated position), any unnecessary portion is not retransferred and only the proper region is retransferred onto the object.

At the time of half cutting of the transparent sheet side including the receptive layer in the intermediate transfer recording medium, when the transparent sheet side is excessively cut in the depth direction, that is, when not only the transparent sheet portion but also the sheet substrate is cut, the whole intermediate transfer recording medium is cut at the cut portion during carriage in the printer, often leading to carriage troubles. On the other hand, when the cut level is excessively low in the depth direction, when a cut is provided, for example, only in the receptive layer without the provision of a cut in the transparent sheet, cutting-off disadvantageously occurs at a position different from the proper cut position at the time of the removal of the refuse on the transparent sheet side.

Therefore, as shown in FIGS. 2 and 4, the depth of the cutting (half cutting) is preferably on a level such that passes through the receptive layer and the transparent sheet and slightly bites the resin layer in the thickness wise direction.

The half cutting according to the present invention may be previously carried out before the formation of an image on the receptive layer in the intermediate transfer recording medium, or alternatively, the half cutting may be carried out according to the image region after the formation of an image on the receptive layer in the intermediate transfer recording medium.

Figure 7:
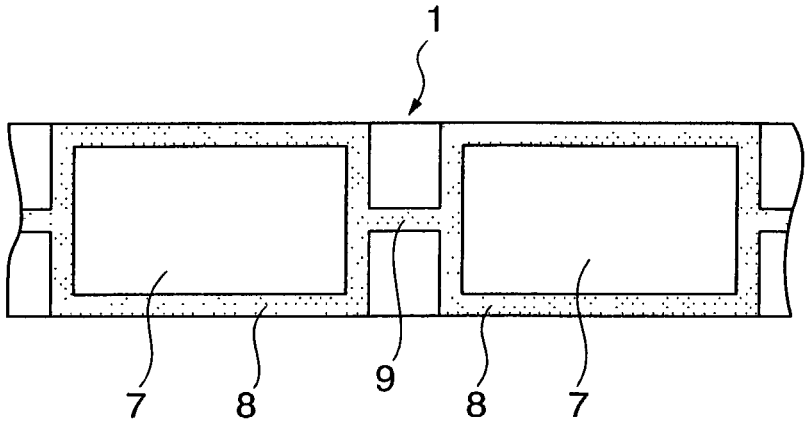
FIG. 7 is a plan view showing an embodiment of the intermediate transfer recording medium according to the present invention.

FIG. 7 is a plan view showing one embodiment of the intermediate transfer recording medium according to the present invention. In this embodiment, a rectangular region 7 to be transferred onto an object is repeatedly provided in the flow direction of a continuous intermediate transfer recording medium 1, and portions 8, where the transparent sheet side including the receptive layer has been removed in a predetermined width around the outer periphery of the region 7 and the adjacent portions 8, from which the transparent sheet side including the receptive layer has been removed, are continuously connected to each other through a connection 9 in the flow direction. This can realize continuous removal of refuse with high efficiency. The intermediate transfer recording medium shown in FIG. 7 is different from the intermediate transfer recording medium shown in FIG. 3 in that the removed portion 8 around the outer periphery of the rectangular region 7 to be transferred onto the object is located at a position that overlaps with the end of the intermediate transfer recording medium per se at both end portions in the flow direction.

FIG. 7 shows an embodiment where both the angle of the corners of the rectangular region 7 to be transferred onto an object and the angle of the corners of the connection 9 are right angle. Preferably, as shown in FIGS. 1, 3, and 6, the corners of the region 7 to be transferred onto an object and the corners of the connection 9 are rounded (R is provided) so as to avoid cutting of refuse on the transparent sheet side from the right-angle corners at the time of the removal of the refuse.

(Identification Mark)

An identification mark 11 for detecting the half cut portion may be provided in the intermediate transfer recording medium according to the present invention.

For example, the shape or the color of the identification mark is not particularly limited so far as the identification mark is detectable with a detector. Examples of shapes of the identification mark include quadrangle as shown in FIG. 5, circle, bar cord, and line extending from the end to end in the widthwise direction of the intermediate transfer recording medium.

The color of the identification mark may be any one detectable with a detector. For example, when a light transmission detector is used, silver, black and other colors having a high level of opaqueness may be mentioned as the color of the identification mark. When a light reflection detector is used, for example, a highly light reflective metal scent color tone may be mentioned as the color of the identification mark.

The identification mark may be formed by any method without particular limitation, and examples of methods usable herein include the provision of through holes which extend from the surface to the backside of the intermediate transfer recording medium, gravure printing or offset printing, the provision of a deposit film by hot stamping using a transfer foil, and the application of a deposit film provided with a pressure-sensitive adhesive on the backside of the intermediate transfer recording medium.

(Method for Image Formation)

The method for image formation according to the present invention comprises the steps of: providing the above intermediate transfer recording medium; putting the intermediate transfer recording medium and a thermal transfer sheet on top of each other so that a transfer layer in the thermal transfer sheet comes into contact with the receptive layer; heating the assembly to form a transfer image on the receptive layer; putting the intermediate transfer recording medium and an object on top of each other so that the receptive layer face comes into contact with the object; and pressing the assembly with heating to retransfer only a region 7 with the image formed thereon onto the object to form an image on the object.

In this case, when the image formed portion is put on top of the object followed by pressing with heating, the image formed portion is included in the area of pressing with heating. Even when the area of pressing with heating is somewhat different from the portion 8 having a predetermined width, around the outer periphery of the region 7, from which the transparent sheet provided with the receptive layer has been removed, the image provided with the transparent sheet, that is, a protective layer, can be transferred onto the object with good accuracy in a simple manner, because the region 7 is independently provided and is not connected to other portions.

Alternatively, the method for image formation may comprise the steps of: providing the above intermediate transfer recording medium; putting the intermediate transfer recording medium and a thermal transfer sheet on top of each other so that a transfer layer in the thermal transfer sheet comes into contact with the receptive layer; heating the assembly to form a transfer image on the receptive layer; further transferring an adhesive layer onto the receptive layer; putting the intermediate transfer recording medium and an object on top of each other so that the adhesive layer face comes into contact with the object; and pressing the assembly with heating to retransfer only a portion with the image and the adhesive layer formed thereon onto the object to form an image on the object.

The transfer of the adhesive layer onto the receptive layer will be described in detail.

The adhesive layer may be transferred onto the receptive layer, for example, by providing an adhesive sheet, which has been formed into a film, inserting the adhesive sheet into between the receptive layer face with the image formed thereon and the object and heat pressing the assembly to adhere the image-receptive layer and the transparent sheet onto the object.

A method may also be adopted which comprises the steps of: providing an adhesive layer transfer sheet comprising an adhesive layer provided on a release paper; and heat pressing the adhesive layer in the adhesive layer transfer sheet against the surface of the receptive layer with the image formed thereon to transfer the adhesive layer.

Adhesive components usable in the adhesive sheet or the adhesive layer transfer sheet include thermoplastic synthetic resins, naturally occurring resins, rubbers, and waxes, and examples thereof include: synthetic resins, for example, cellulose derivatives such as ethyl cellulose and cellulose acetate propionate, styrene polymers such as polystyrene and poly-α-methylstyrene, acrylic resins such as polymath methacrylate, polyethylene methacrylate, and polyethylene acryl ate, vinyl resins such as polyvinyl chloride, polyvinyl acetate, vinyl chloride-vinyl acetate copolymer, and polyvinyl butyric, polyester resins, polyamide resins, epoxy resins, polyurethane resins, monomers, olefins, and ethylene-acrylic acid copolymers; and pacifiers, for example, naturally occurring resin and synthetic rubber derivatives, such as rosins, rosin-modified malefic acid resins, ester gums, polyisobutylene rubbers, butyl rubbers, styrene-butadiene rubbers, and butadiene-acrylonitrile rubbers. A single or plurality of adhesive components may be used, and the use of a material, which can develop adhesive properties upon heating, is preferred.

The thickness of the adhesive sheet or the adhesive layer in the adhesive layer transfer sheet is about 0.1 to 500 μm.

In the transfer of the adhesive layer, for example, a thermal head used in the formation of a transferred image, a line heater, a heat roll, or a hot stamp may be used as heating means.

An image may be formed on the intermediate transfer recording medium by a conventional sublimation thermal transfer method or hot-melt thermal transfer method. For example, a thermal transfer sheet comprising color transfer layers of three colors of yellow, cyan, and magenta provided in a face serial manner is used to form a desired full-color image on the receptive layer in the intermediate transfer recording medium by a conventional thermal transfer printer of thermal head type or laser heating type. Next, the transparent sheet including the receptive layer with the image formed thereon may be separated from the sheet substrate provided with the resin layer and transferred and applied to a desired object.

For example, a thermal head used in the formation of a transferred image, a line heater, a heat roll, or a hot stamp may be used as means for transferring the transparent sheet including the receptive layer with the image formed thereon onto an object.

It should be noted that, in order that the image finally formed on the object according to the present invention is properly oriented, an image, which is in a mirror image relationship with the final image, should be formed on the receptive layer in the intermediate transfer recording medium.

The object, on which the image is retransferred from e the intermediate transfer recording medium according to the present invention, is not particularly limited. For example, any sheet of plain paper, wood free paper, tracing paper, and plastic film may be used. Regarding the shape of the object, for example, any of cards, postal cards, passports, letter paper, report pads, notebooks, catalogs, cups, and cases may be used.

Second Invention

Preferred embodiments of the second invention will be described in detail.

Figure 8A:
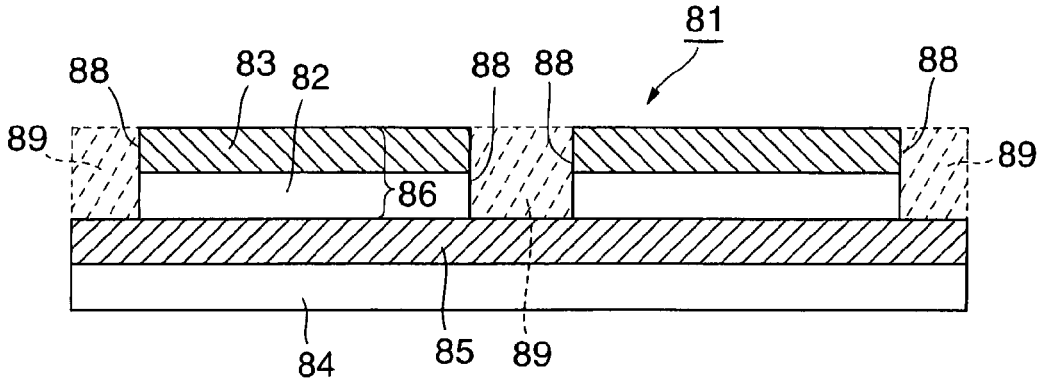
FIGS. 8A and 8B each are a schematic view showing an embodiment of the intermediate transfer recording medium according to the present invention.
Figure 8B:
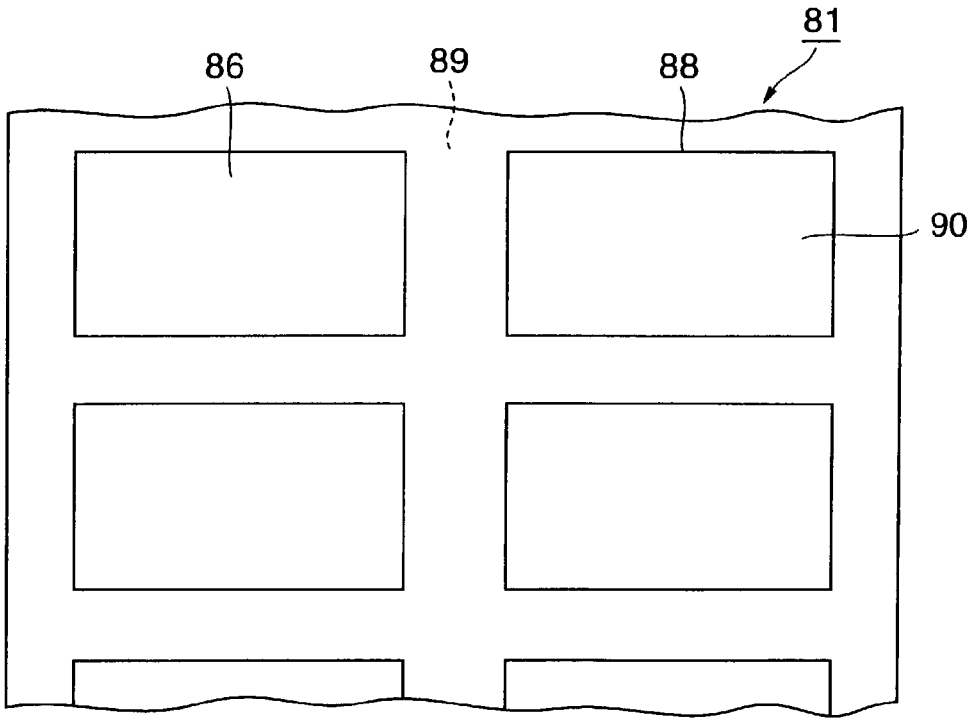

FIGS. 8A and 8B are schematic views showing one embodiment of the intermediate transfer recording medium according to the present invention. Specifically, FIG. 8A is a schematic cross-sectional view of an intermediate transfer recording medium 81 wherein a resin layer 85 is provided on a support 84 and a transparent sheet 86 comprising a transparent substrate 82 provided with a receptive layer 83 is provided on the resin layer 85 so that the resin layer 85 is separable from the transparent substrate 82. The transparent sheet portion 86 including the receptive layer 83 has been subjected to half cutting 88 to remove an unnecessary portion 89 in the transparent sheet. FIG. 8B is a schematic plan view of the intermediate transfer recording medium shown in FIG. 8A. The intermediate transfer medium 81 is a continuous intermediate transfer medium, and the transparent sheet portions 86 are quadrangular and are repeatedly arranged in two rows in the direction of carriage. Specifically, in this transparent sheet portion 86, the outer side of the quadrangle has been subjected to half cutting 88 to remove the unnecessary portion 89 while leaving the necessary quadrangular portion.

Figure 9A:
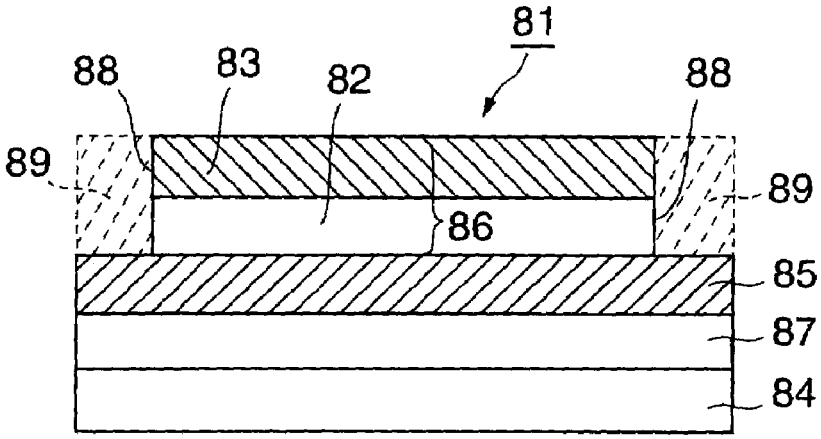
FIGS. 9A and 9B each are a schematic view showing another embodiment of the intermediate transfer recording medium according to the present invention.
Figure 9B:
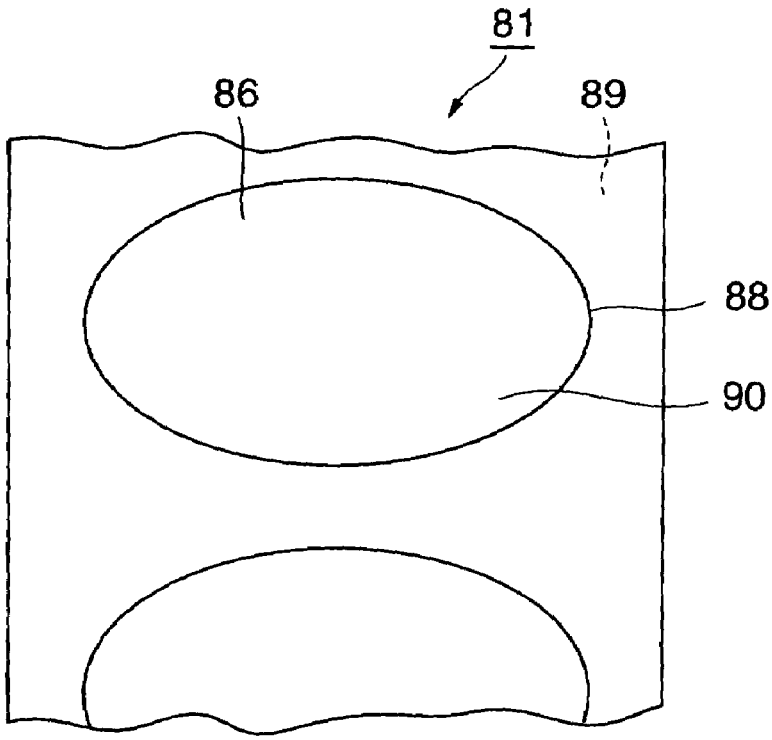

FIGS. 9A and 9B are schematic views showing another embodiment of the intermediate transfer recording medium according to the present invention. Specifically, FIG. 9A is a schematic cross-sectional view of an intermediate transfer recording medium 81 wherein an intermediate layer 87 and a resin layer 85 are provided in that order on a support 84 and a transparent sheet 86 comprising a transparent substrate 82 provided with a receptive layer 83 is provided on the resin layer 85 so that the resin layer 85 is separable from the transparent substrate 82. The transparent sheet portion 86 including the receptive layer 83 has been subjected to half cutting 88 to remove an unnecessary portion 89 in the transparent sheet. FIG. 9B is a schematic plan view of the intermediate transfer recording medium shown in FIG. 9A. The intermediate transfer medium 81 is a continuous intermediate transfer medium, and the transparent sheet portions 86 are elliptical and are repeatedly arranged in the direction of carriage. Specifically, in this transparent sheet portion 86, the peripheral portion of the ellipse has been subjected to half cutting 88 to remove the unnecessary portion 89 while leaving the elliptical necessary portion.

(Transparent Substrate)

In the transparent substrate 82 in the intermediate transfer recording medium according to the present invention, the transparent sheet portion comprising at least a receptive layer and a transparent substrate has been cut using the half cut portion as the boundary between the removal portion and the portion remaining unresolved, and the transparent substrate can function as a protective layer in such a state that the transparent substrate covers the surface of the image formed portion. The transparent substrate may be any one so far as the sheet is transparent and has fastness or resistance properties, such as weathering resistance, abrasion resistance, and chemical resistance. Examples of transparent sheets usable herein include about 0.5 to 100 μm-thick, preferably about 10 to 40 μm-thick, films of polyethylene terephthalate, 1,4-polycyclohexylene dim ethylene terephthalate, polyethylene naphtha late, polyphenylene sulfide, polystyrene, polypropylene, polysulfide, agamid, polycarbonate, polyvinyl alcohol, cellulose derivatives, such as cellophane and cellulose acetate, polyethylene, polyvinyl chloride, nylon, polyimide, and monomer.

(Release Treatment)

The transparent substrate in its side facing the resin layer may be subjected to release treatment to facilitate the separation of the transparent substrate from the resin layer. In the release treatment, a release layer is provided on the transparent substrate. The release layer may be formed by coating a coating liquid containing a wax, a silicone wax, a silicone resin, a fluororesin, an acrylic resin, a polyvinyl alcohol rein, a cellulose derivative resin or the like or a copolymer of monomers constituting the above group of resins onto the transparent sheet by conventional formation means, such as gravure printing, screen printing, or reverse roll coating using a gravure plate, and drying the coating. The coverage of the release layer is about 0.1 to 10 g/m$^2$ on a dry basis.

(Receptive Layer)

The receptive layer 83 may be formed on the transparent substrate either directly or through a primer layer. The construction of the receptive layer 83 varies depending upon the recording method, that is, whether the recording method is thermal ink transfer recording or thermal dye sublimation transfer recording. In the hot-melt transfer recording, a method may also be adopted wherein a color transfer layer is thermally transferred from the thermal transfer sheet directly onto the transparent sheet without providing the receptive layer. In the hot-melt transfer recording and the sublimation transfer recording, the receptive layer functions to receive a colorant thermally transferred from the thermal transfer sheet. In particular, in the case of the sublimely dye, preferably, the receptive layer receives the dye, develops a color, and, at the same time, does not permit republication of the once received dye. A transfer image is formed on a receptive layer in an intermediate transfer recording medium, and only the image formed portion is retransferred onto an object to form an image on the object. The receptive layer according to the present invention is generally transparent so that an image transferred onto the object can be clearly viewed from the top. However, it is also possible to intentionally make the receptive layer opaque or to intentionally lightly color the receptive layer to render the re-transferred image distinct.

The receptive layer is generally composed mainly of a thermoplastic resin. Examples of materials usable for forming the receptive layer include: polyolefin resins such as polypropylene; halogenated polymers such as vinyl chloride-vinyl acetate copolymer, ethylene-vinyl acetate copolymer, and polyvinylidene chloride; polyester resins such as polyvinyl acetate and polycyclic esters; polystyrene resins; polyamide resins; copolymer resins produced from olefins, such as ethylene and propylene, and other vinyl monomers; monomers; cellulosic resins such as cellulose dictate; and polycarbonate resins. Among them, polyester resins and vinyl chloride-vinyl acetate copolymer and mixtures of these resins are particularly preferred.

In sublimation transfer recording, a release agent may be incorporated into the receptive layer, for example, from the viewpoint of preventing fusing between the thermal transfer sheet having a color transfer layer and the receptive layer in the intermediate transfer recording medium at the time of image formation or preventing a lowering in sensitivity in printing. Preferred release agents usable as a mixture include silicone oils, phosphoric ester surfactants, and fluorosurfactants. Among them, silicone oils are preferred. Preferred silicone oils include epoxy-modified, vinyl-modified, alkyl-modified, amino-modified, carboxyl-modified, alcohol-modified, fluorine-modified, alkyl a alkyl polyether-modified, epoxy-polyether-modified, polyether-modified and other modified silicone oils.

A single or plurality of release agents may be used. The amount of the release agent added is preferably 0.5 to 30 parts by weight based on 100 parts by weight of the resin for the receptive layer. When the amount of the release agent added is outside the above amount range, problems sometimes occur such as fusing between the sublimation-type thermal transfer sheet and the receptive layer in the intermediate transfer recording medium or a lowering in sensitivity in printing. The addition of the release agent to the receptive layer permits the release agent to bleed out on the surface of the receptive layer after the transfer to form a release layer. Alternatively, these release agents may be separately coated onto the receptive layer without being incorporated into the receptive layer. The receptive layer may be formed by coating a solution of a mixture of the above resin with a necessary additive, such as a release agent, in a suitable organic solvent, or a dispersion of the mixture in an organic solvent or water onto a transparent sheet by conventional forming means such as gravure coating, gravure reverse coating, or roll coating, and drying the coating. The receptive layer may be formed in any thickness. In general, however, the coverage of the receptive layer is 1 to 50 g/m$^2$ on a dry basis. The receptive layer is preferably in the form of a continuous coating. However, the receptive layer may be in the form of a discontinuous coating formed using a resin emulsion, a water-soluble resin, or a resin dispersion. Further, an antistatic agent may be coated onto the receptive layer from the viewpoint of realizing stable carrying of sheets through a thermal transfer printer.

(Support)

The support 4 used in the present invention is not particularly limited, and examples thereof include: various types of paper, for example, capacitor paper, glassine paper, parchment paper, or paper having a high sizing degree, synthetic paper (such as polyolefin synthetic paper and polystyrene synthetic paper), cellulose fiber paper, such as wood free paper, art paper, coated paper, cast coated paper, wall paper, backing paper, synthetic resin- or emulsion-impregnated paper, synthetic rubber latex-impregnated paper, paper with synthetic resin internally added thereto, and paperboard; and films of polyester, polyacrylate, polycarbonate, polyurethane, polyimide, polyether imides, cellulose derivative, polyethylene, ethylene-vinyl acetate copolymer, polypropylene, polystyrene, acrylic resin, polyvinyl chloride, polyvinylidene chloride, polyvinyl alcohol, polyvinyl butyric, nylon, polyether ether ketene, polysulfide, polyether sulfide, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like.

The thickness of the support is preferably about 10 to 50 μm. The thickness of the support is preferably relatively small from the viewpoint of thermal efficiency at the time of transfer from the intermediate transfer recording medium to the object. In order to facilitate the transfer onto the object, preferably, the intermediate transfer recording medium is half cut, and the thickness of the support should be about 25 μm from the viewpoint of suitability for half cutting. When the support is excessively thin, curling or cockling occurs in the intermediate transfer recording medium. On the other hand, when the support is excessively thick, the thermal efficiency at the time of transfer from the intermediate transfer recording medium to the object is disadvantageously deteriorated.

(Resin Layer)

The resin layer 5 provided on the support is composed mainly of a polyallylate resin. The polyallylate resin is a polycondensate of a biphenol component with an aromatic dicarboxylic acid component. Examples of the biphenol component include 2,2-bis(4-hydroxyphenyl)propane (biphenol A), 1,1-bis(4-hydroxyphenyl)-1-phenylethane (biphenyl AP), 2,2-bis(3-methyl-4-hydroxyphenyl)propane (biphenol C), and 1,1-bis(4-hydroxyphenyl)cyclopean (biphenyl Z). In particular, a polyacrylate resin of biphenyl AP alone or of a mixture type composed of biphenyl A and biphenyl AP is preferred because this polyacrylate resin is easily dissolved in non-chlorinated hydrocarbon solvents, such as toluene and cyclohexanone, can realize the formation of a resin layer without the need to use highly harmful chlorinated hydrocarbon solvents or the like by coating, and thus is safe in work environment.

Examples of the aromatic dicarboxylic acid component of the polyallylate resin usable in the present invention include terephthalic acid, isophthalic acid, o-ophthalmic acid, 2,6-naphthalenedicarboxylic acid, 5-tert-butylisophthalic acid, diaphonic acid, 4,4'-dicarboxydiphenyl ether, bis(p-carboxyphenyl)alkane, and 4,4'-dicarboxyphenylsulfonic acid. Any one of these dicarboxylic acids may be used, or alternatively two or more of the dicarboxylic acids may be used in combination. Terephthalic acid and isophthalic acid are particularly preferred as the dicarboxylic acid.

In the present invention, in the intermediate transfer recording medium comprising: a transparent sheet comprising at least a transparent substrate and a receptive layer; and a support, the transparent sheet having been stacked on the support through a resin layer so that the resin layer is separable from the transparent substrate, the use of a polyallylate resin in the resin layer can prevent, at the time of the transfer of the transparent sheet onto the object, an increase in the peel force between the resin layer and the transparent sheet caused by a change with the elapse of time, can realize stable release of the transparent sheet from the intermediate transfer medium, and, at the same time, can prevent fusing between the resin layer and the thermal transfer sheet at the time of image formation on the receptive layer which results in breaking of the thermal transfer sheet.

To further stabilize the reliability from the thermal transfer sheet at the time of image formation and reparability at the time of transfer onto the object, the resin layer in the intermediate transfer medium may contain an inorganic or organic filler. Inorganic fillers usable herein include, for example, calcium carbonate, magnesium carbonate, titanium oxide, silicon oxide, barium sulfate, zinc oxide, talc, kaolin, and clay. Organic fillers usable herein include polystyrene resins, melamine resins, acrylic resins, and organic silicones. The size of these fillers is preferably about 0.01 to 5 μm in terms of average particle diameter.

The content of the filler in the resin layer is preferably in the range of about 0.01 to 20 parts by weight based on 100 parts by weight of the resin on a solid basis.

When the peel force between the resin layer and the transparent substrate is 0.01 to 0.5 N/inch as measured at a peel angle of 180 degrees according to the method specified in JIS Z 0237, accidental separation of the transparent sheet during handling of the intermediate transfer recording medium, such as separation of the transparent sheet side in the intermediate transfer recording medium in a thermal transfer printer during image formation, can be avoided and, in addition, the reparability at the time of transfer of the transparent sheet onto an object is good.

The peel force is preferably 0.03 to 0.2 N/inch because accidental separation of the transparent sheet side during handling of the intermediate transfer recording medium can be avoided and the transferability onto an object is better.

The resin layer may be formed by providing the above-described polyallylate resin as a main component, optionally adding another thermoplastic resin having a glass transition temperature of about 200° C. so far as the releasability of the intermediate transfer recording medium from the thermal transfer sheet at the time of image formation and the separability at the time of transfer onto an object are not sacrificed, optionally adding the above filler, adding a solvent, such as toluene or cyclohexanone, to the mixture to prepare a coating liquid, coating the coating liquid onto a support by conventional formation means, such as gravure coating, gravure reverse coating, or roll coating, and drying the coating. The coverage of the resin layer is set so that the peel force between the resin layer and the transparent substrate is in the above-defined range and is generally about 0.1 to 10 g/m$^2$ on a dry basis.

When a transparent substrate is stacked on the resin layer, a method may be adopted wherein a resin layer is formed by coating on the support or the transparent substrate in its side remote from the receptive layer and the support side and the transparent substrate side are laminated, for example, by dry lamination or hot melt lamination so that the support, the resin layer, and the transparent substrate are stacked in that order to provide a layer construction of support/resin layer/transparent substrate.

(Intermediate Layer)

In providing the resin layer on the support, an intermediate layer 7 may be provided on the surface of the support to improve the adhesion between the support and the resin layer. Instead of the provision of the intermediate layer, the surface of the support may be subjected to corona discharge treatment. The intermediate layer may be formed by providing a coating liquid, prepared by dissolving or dispersing polyester resin, polycyclic ester resin, polyvinyl acetate resin, polyurethane resin, polyamide resin, polyethylene resin, polypropylene resin or the like in a solvent and coating the coating liquid by the same formation means as used in the formation of the receptive layer. The coverage of the intermediate layer is about 0.1 to 5 g/m$^2$ on a dry basis. The intermediate layer as described above may also be provided between the transparent substrate and the receptive layer.

A suitable slip layer may be provided on the support in its side remote from the resin layer, for example, from the viewpoint of improving the variability at the time of sheet feeding in a thermal transfer printer. The slip layer may be formed using a material prepared by adding various fine particles or lubricants such as silicone to one of or a blend of two or more of conventional resins such as butyric resin polycyclic ester, polymethacrylic ester, polyvinylidene chloride, polyester, polyurethane, polycarbonate, or polyvinyl acetate.

The intermediate transfer recording medium according to the present invention comprises at least a receptive layer, a transparent substrate, a resin layer, and a support stacked in that order so that the resin layer is separable from the transparent substrate. An antistatic layer may be provided on the surface of the receptive layer, the backside of the support, or the outermost surface of both sides. The antistatic layer may be formed by coating a solution or dispersion of an antistatic agent, such as a fatty ester, a sulfuric ester, a phosphoric ester, an amide, a quaternary ammonium salt, a beanie, an amino acid, an acrylic resin, or an ethylene oxide adduct, in a solvent. The forming means used may be the same as that used in the formation of the receptive layer. The coverage of the antistatic layer is preferably 0.001 to 0.1 g/m$^2$ on a dry basis.

An intermediate layer formed of one of various resins may be provided between the transparent substrate and the receptive layer in the transparent sheet. In this case, the intermediate layer is preferably transparent so that the retransferred image can be viewed. When the intermediate layer has various functions, excellent functions can be imparted to the image-receiving sheet. For example, a highly elastically deformable or plastically deformable resin, for example, a polyolefin resin, a vinyl copolymer resin, a polyurethane resin, or a polyamide resin, may be used as a cushioning property-imparting resin to improve the sensitivity in printing of the image-receiving sheet or to prevent harshness of images. Antistatic properties may be imparted to the intermediate layer by adding the antistatic agent to the cushioning property-imparting resin, dissolving or dispersing the mixture in a solvent, and coating the solution or dispersion to form an intermediate layer.

(Half Cutting)

In the intermediate transfer recording medium according to the present invention, preferably, the transparent sheet portion including at least the receptive layer and the transparent substrate has been subjected to half cutting 88. The half cut may be formed by any method without particular limitation so far as half cutting is possible. Examples of methods usable for half cutting include a method wherein the intermediate transfer recording medium is inserted into between an upper die provided with a cutter blade and a pedestal and the upper die is then vertically moved, a method wherein a cylinder-type rotary cutter is used, and a method wherein heat treatment is carried out by means of a laser beam. As shown in FIGS. 8A and 8B, the unnecessary portion 89 in the transparent sheet 86 is previously separated and removed using the half cut portion 88 as the boundary between the portion remaining unresolved and the removal portion, and, at the time of image formation, the receptive layer 83 provided on the transparent substrate 82 is left as the image formed portion 90. This can eliminate a fear of the transparent sheet 86 being cut at the time of the retransfer of the image onto the object. Thus, the image formed portion 90 can be surely transferred onto the object.

The half cutting may be previously formed in the transparent sheet portion of the intermediate transfer recording medium before image formation. Alternatively, after the formation of an image on the transparent sheet in the intermediate transfer recording medium, half cutting may be carried out along the image region.

The intermediate transfer recording medium is put on top of a thermal transfer sheet so that the receptive layer comes into contact with the transfer layer in the thermal transfer sheet. The assembly is heated to form a transferred image on the receptive layer. Thereafter, the intermediate transfer recording medium with the image formed on the receptive layer is put on top of an object so that the surface of the receptive layer comes into contact with the object. The assembly is heated and pressed to retransfer only the image formed portion onto the object to form an image on the object. In this case, in putting the image formed portion on top of the object followed by heating and contact bonding, even when the image formed portion is included in the heating and contact bonding area and when the heating and contact bonding area is somewhat larger than the area surrounded by the half cut, since the transparent sheet portion including the receptive layer has been half cut, the transparent sheet portion is clearly cut at the half cut portion, the transparent sheet, that is, the image provided with the protective layer, can be transferred in an accurate and simple manner. It is a matter of course that, when half cutting is carried out to previously remove the unnecessary portion 89 while leaving the image formed portion 90, the transparent sheet can be more simply transferred onto the object.

Further, an image may be formed on an object by putting the intermediate transfer recording medium on top of the thermal transfer sheet so that the receptive layer comes into contact with the transfer layer in the thermal transfer sheet, heating the assembly to form a transferred image on the receptive layer, further transferring an adhesive layer onto the receptive layer, putting the intermediate transfer recording medium with the image and the adhesive layer formed thereon on top of an object so that the surface of the adhesive layer comes into contact with the object, and heating and pressing the assembly to retransfer only the image and adhesive layer formed portion onto the object. The transfer of the adhesive layer onto the receptive layer will be described in more detail. In transferring the adhesive layer onto the receptive layer, for example, an adhesive sheet in a film form is provided. The adhesive sheet may be inserted into between the surface of the receptive layer with the image formed thereon and the object, followed by contact bonding with heating to adhere the transparent sheet including the receptive layer with the image formed thereon onto the object. Alternatively, a method may be used wherein an adhesive layer transfer sheet comprising an adhesive layer provided on a release paper is provided and the adhesive layer in the adhesive layer transfer sheet is heated and contact bonded to transfer the adhesive layer onto the image formed receptive layer.

Adhesive components usable in the adhesive sheet or the adhesive layer transfer sheet include thermoplastic synthetic resins, naturally occurring resins, rubbers, and waxes, and examples thereof include: synthetic resins, for example, cellulose derivatives such as ethyl cellulose and cellulose acetate propionate, styrene polymers such as polystyrene and poly-α-methyl styrene, acrylic resins such as polymath methacrylate, polyethylene methacrylate, and polyethylene acryl ate, vinyl resins such as polyvinyl chloride, polyvinyl acetate, vinyl chloride-vinyl acetate copolymer, and polyvinyl butyric, polyester resins, polyamide resins, epoxy resins, polyurethane resins, monomers, olefins, and ethylene-acrylic acid copolymers; and tackifiers, for example, naturally occurring resins and synthetic rubber derivatives, such as rosins, rosin-modified malefic acid resins, ester gums, polyisobutylene rubbers, butyl rubbers, styrene-butadiene rubbers, and butadiene-acrylonitrile rubbers. A single or plurality of adhesive components may be used, and the use of a material, which can develop adhesive properties upon heating, is preferred. The thickness of the adhesive sheet or the adhesive layer in the adhesive layer transfer sheet is about 0.1 to 500 μm. In the transfer of the adhesive layer, for example, a thermal head used in the formation of a transferred image, a line heater, a heat roll, or a hot stamp may be used as heating means.

An image may be formed on the intermediate transfer recording medium by a conventional thermal dye sublimation transfer method or thermal ink transfer method. For example, a thermal transfer sheet comprising color transfer layers of three colors of yellow, cyan, and magenta provided in a face serial manner is used to form a desired full-color image on the receptive layer in the intermediate transfer recording medium by a conventional thermal transfer printer of thermal head type or laser heating type. Next, the transparent sheet including the receptive layer with the image formed thereon may be separated from the support provided with the resin layer and transferred and applied to a desired object. It should be noted that, in order that the image finally formed on the object according to the present invention is properly oriented, an image, which is in a mirror image relationship with the final image, should be formed on the receptive layer in the intermediate transfer recording medium. The object, on which the image is retransferred from the intermediate transfer recording medium according to the present invention, is not particularly limited. For example, any sheet of plain paper, wood free paper, tracing paper, and plastic film may be used. Regarding the shape of the object, for example, any of cards, postal cards, passports, letter paper, report pads, notebooks, catalogs, cups, and cases may be used.

EXAMPLES

The following examples further illustrate the present invention but are not intended to limit it. In the following description, "parts" is by weight.

Example A1

A coating liquid having the following composition for a receptive layer was coated onto a 25 μm-thick polyethylene terephthalate (PET) film ("Lumirror," manufactured by Toray Industries, Inc.) as a transparent sheet, and the coating was dried to form a receptive layer having a thickness of 4 μm on a dry basis. The transparent sheet with the receptive layer formed thereon was then applied to a 25 μm-thick PET film ("Lumirror," manufactured by Toray Industries, Inc.) as a support film through a 20 μm-thick layer of low density polyethylene ("Mirason 16 P," density 0.923 g/cm$^3$, lower side temperature of die 295° C., manufactured by Mitsui Petrochemical Industries, Ltd.) by extrusion lamination to prepare an intermediate transfer medium. In this case, the support film used was such that the support film on its side, where the low density polyethylene was to be stacked, had been subjected to corona treatment. Further, the extrusion lamination was carried out in such a manner that the untreated (uncoated) surface of the PET film as the transparent sheet remote from the receptive layer came into contact with the low density polyethylene.

Reference Example A1

An intermediate transfer medium was prepared in the same manner as in Example A1, except that the lower side temperature of the die at the time of extrusion lamination was changed to 305° C.

Reference Example A2

An intermediate transfer medium was prepared in the same manner as in Example A1, except that the lower side temperature of the die at the time of extrusion lamination was changed to 330° C.

Reference Example A3

An intermediate transfer recording medium was prepared in the same manner as in Example A1, except that the resin to be extrusion laminated was changed to polypropylene (F 329 RA, manufactured by Grand Polymer Co., Ltd., lower side temperature of die 290° C.).

Example A2

An intermediate transfer recording medium was prepared in the same manner as in Example A1, except that the resin to be extrusion laminated in Example A1 was changed to medium density polyethylene (Sumikathene L 5721, density 0.937 g/cm$^3$, lower side temperature of die 320° C., manufactured by Sumitomo Chemical Co., Ltd.).

Example A3

A coating liquid having the following composition for a receptive layer was coated onto a 25 μm-thick polyethylene terephthalate (PET) film ("Lumirror," manufactured by Toray Industries, Inc.) as a transparent sheet, and the coating was dried to form a receptive layer having a thickness of 4 μm on a dry basis. A first resin layer composed mainly of an acrylic resin (acrylic resin/polyester resin/polyethylene wax=30/0.2/2) was stacked in a thickness of 1 μm on a dry basis onto the transparent sheet in its side remote from the receptive layer. Further, a urethane adhesive (Takelac A-969 V/Takenate A-5 (manufactured by Takeda Chemical Industries, Ltd.)=3/1) was stacked thereon to a thickness of 2.5 μm on a dry basis, and, in addition, a 25 μm-thick PET film ("Lumirror," manufactured by Toray Industries, Inc.) as a support film was dry laminated thereto to prepare an intermediate transfer recording medium.

Example A4

A coating liquid having the following composition for a receptive layer was coated onto a 25 μm-thick polyethylene terephthalate (PET) film ("Lumirror," manufactured by Toray Industries, Inc.) as a transparent sheet, and the coating was dried to form a receptive layer having a thickness of 4 μm on a dry basis. A first resin layer formed of an acrylic resin was stacked in a thickness of 1 μm on a dry basis onto the transparent sheet in its side remote from the receptive layer. Further, a second resin layer formed of an ethylene-vinyl acetate copolymer resin was stacked thereon in a thickness of 1 μm on a dry basis. The laminate was then applied to a 25 μm-thick PET film ("Lumirror," manufactured by Toray Industries, Inc.) as a support film through a 20 μm-thick layer of low density polyethylene ("Mirason 16 P", density 0.923 g/cm$^3$, lower side temperature of die 330° C., manufactured by Mitsui Petrochemical Industries, Ltd.) by extrusion lamination to prepare an intermediate transfer recording medium.

Reference Example A4

A coating liquid having the following composition for a receptive layer was coated onto a 25 μm-thick polyethylene terephthalate (PET) film ("Lumirror," manufactured by Toray Industries, Inc.) as a transparent sheet, and the coating was dried to form a receptive layer having a thickness of 4 μm on a dry basis. Separately, a 25 μm-thick PET film ("Lumirror," manufactured by Toray Industries, Inc.) was provided as a support film, and a resin layer (NBR resin/carnauba wax=100/2) was stacked on the support film to a thickness of 3 μm on a dry basis. The transparent sheet with the receptive layer formed thereon was dry laminated onto the support film with the resin layer provided thereon so that the surface of the transparent sheet remote from the receptive layer faced the resin layer. Thus, an intermediate transfer recording medium was prepared.

| (Composition of coating liquid for receptive layer) | |
|---|---|
| Vinyl chloride-vinyl acetate copolymer (VYHD, manufactured by Union Carbide Corporation) | 100 parts |
| Epoxy-modified silicone (KF-393, manufactured by The Shin-Etsu Chemical Co., Ltd.) | 8 parts |
| Amino-modified silicone (KS-343, manufactured by The Shin-Etsu Chemical Co., Ltd.) | 8 parts |
| Methyl ethyl ketone/toluene (weight ratio = 1/1) | 400 parts |

For the intermediate transfer recording media thus prepared, the image non-forming portion was half cut and was removed, followed by continuous winding to form a roll.

The samples thus obtained were evaluated for reliability and blocking. The results are shown in Table A1 below.

TABLE A1

| Example No. | Releasability | Anti-blocking property |
|---|---|---|
| Example A1 | 3 | Good |
| Example A2 | 3 | Good |
| Reference Example A1 | 4 | Good |
| Reference Example A2 | 5 | Good |
| Reference Example A3 | 1 | Good |
| Example A3 | 3 | Good |
| Example A4 | 3 | Good |
| Reference Example A4 | 4 | Failure |

In this case, evaluation criteria were as follows.

Reliability: The reliability of the transparent sheet from the first resin layer provided on the support sheet was evaluated.

1: light

3: moderate

5: heavy

Blocking: After the image non-forming portion was removed, the intermediate transfer recording medium was wound into a roll. The roll was then allowed to stand under conditions of 40° C. for 48 hr, and sticking between the first resin layer and the backside of the support sheet was then evaluated.

As is apparent from the above results, the adoption of the construction of the present invention could simultaneously realize, in a good balance, contradictory properties, i.e., a property such that blocking does not occur upon winding in a roll form of the intermediate transfer recording medium with the image non-forming portion removed there from and a property such that, at the time of unwinding, the reliability of the transparent sheet from the resin layer provided on the support sheet is good.

As is also apparent from the results of the above examples, the intermediate transfer recording medium according to the present invention can solve the problem involved in the prior art technique, i.e., the problem of blocking, and has excellent reliability.

Example B1

A 25 μm-thick polyethylene terephthalate film ("Lumirror," manufactured by Toray Industries, Inc.) was provided as a transparent substrate. A coating liquid for a receptive layer having the following composition was coated onto the transparent substrate to provide a receptive layer at a coverage of 4 g/m$^2$ on a dry basis. Separately, a coating liquid for a resin layer having the following composition was coated onto a 25 μm-thick polyethylene terephthalate film ("Lumirror," manufactured by Toray Industries, Inc.) as a support to provide a resin layer at a coverage of 2 g/m$^2$ on a dry basis. The polyethylene terephthalate film provided with a receptive layer was applied to top of the support provided with a resin layer by dry lamination so that the surface of the transparent substrate remote from the receptive layer faced the resin layer on the support. Further, in the laminate thus obtained, as shown in FIGS. 8A and 8B, the transparent sheet portion including the receptive layer was subjected to half cutting by pressing an upper die provided with a cutter blade and a pedestal against the transparent sheet portion including the receptive layer. The transparent sheet portion was cut using the half cut portion as the boundary between the removal portion and the image forming portion remaining unresolved, and the transparent sheet portion including the receptive layer except for the image forming portion was separated and removed, followed by continuous winding to form a roll. Thus, an intermediate transfer recording medium of Example B1 was provided. In this intermediate transfer recording medium, the resin layer was separable from the transparent substrate.

| Composition of coating liquid for receptive layer | |
|---|---|
| Vinyl chloride-vinyl acetate copolymer (#1000 A, manufactured by Denki Kagaku Kogyo K.K.) | 100 parts |
| Epoxy-modified silicone (KF-393, manufactured by The Shin-Etsu Chemical Co., Ltd.) | 5 parts |
| Amino-modified silicone (KF-343, manufactured by The Shin-Etsu Chemical Co., Ltd.) | 5 parts |
| Methyl ethyl ketone/toluene (weight ratio = 1/1) | 400 parts |

-continued

| Composition of coating liquid for resin layer | |
|---|---|
| Polyallylate resin (PAR-8, manufactured by Unitika Ltd.; a polycondensate of bisphenol A and bisphenol AP as bisphenol components with terephthalic acid and isophthalic acid as aromatic dicarboxylic acid components, glass transition temperature 210° C.) | 100 parts |
| Methyl ethyl ketone/toluene (weight ratio = 1/1) | 400 parts |

Example B2

An intermediate transfer recording medium of Example B2 was provided in the same manner as in Example B1, except that the coating liquid for a resin layer was changed to a coating liquid for a resin layer having the following composition.

| Composition of coating liquid for resin layer | |
|---|---|
| Polyallylate resin (PAR-3, manufactured by Unitika Ltd.; a polycondensate of bisphenol A and bisphenol AP as bisphenol components with terephthalic acid and isophthalic acid as aromatic dicarboxylic acid components, glass transition temperature 240° C.) | 100 parts |
| Methyl ethyl ketone/toluene (weight ratio = 1/1) | 400 parts |

Example B3

An intermediate transfer recording medium of Example B3 was provided in the same manner as in Example B1, except that the coating liquid for a resin layer was changed to a coating liquid for a resin layer having the following composition.

| Composition of coating liquid for resin layer | |
|---|---|
| Polyallylate resin (MF-1000, manufactured by Unitika Ltd.; a polycondensate of bisphenol A and bisphenol AP as bisphenol components with terephthalic acid and isophthalic acid as aromatic dicarboxylic acid components, glass transition temperature 270° C.) | 100 parts |
| Methyl ethyl ketone/toluene (weight ratio = 1/1) | 400 parts |

Comparative Example B1

An intermediate transfer recording medium of Comparative Example B1 was provided in the same manner as in Example B1, except that the coating liquid for a resin layer was changed to a coating liquid for a resin layer having the following composition.

| Composition of coating liquid for resin layer | |
|---|---|
| Norbornene resin (F 5022, manufactured by Japan Synthetic Rubber Co., Ltd., glass transition temperature 171° C.) | 100 parts |
| Methyl ethyl ketone/toluene (weight ratio = 1/1) | 400 parts |

Comparative Example B2

An intermediate transfer recording medium of Comparative Example B2 was provided in the same manner as in Example B1, except that the coating liquid for a resin layer was changed to a coating liquid for a resin layer having the following composition.

| Composition of coating liquid for resin layer | |
|---|---|
| Chlorinated polypropylene resin (HP 620, manufactured by Nippon Paper Industries Co., Ltd., glass transition temperature 300° C.) | 100 parts |
| Methyl ethyl ketone/toluene (weight ratio = 1/1) | 400 parts |

Comparative Example B3

An intermediate transfer recording medium of Comparative Example B3 was provided in the same manner as in Example B1, except that the coating liquid for a resin layer was changed to a coating liquid for a resin layer having the following composition.

| Composition of coating liquid for resin layer | |
|---|---|
| Polyamide-imide resin (MT 5050 L 3 V 1, manufactured by Toyobo Co., Ltd., glass transition temperature 260° C.) | 100 parts |
| Methyl ethyl ketone/toluene (weight ratio = 1/1) | 400 parts |

Comparative Example B4

An intermediate transfer recording medium of Comparative Example B4 was provided in the same manner as in Example B1, except that the coating liquid for a resin layer was changed to a coating liquid for a resin layer having the following composition.

| Composition of coating liquid for resin layer | |
|---|---|
| Acrylic resin (BR-85, manufactured by Mitsubishi Rayon Co., Ltd., glass transition temperature 105° C.) | 100 parts |
| Methyl ethyl ketone/toluene (weight ratio = 1/1) | 400 parts |

Comparative Example B5

A 25 μm-thick polyethylene terephthalate film ("Lumirror," manufactured by Toray Industries, Inc.) was provided as a transparent substrate. The same coating liquid for a receptive layer as used in Example 1 was coated onto the transparent substrate to provide a receptive layer at a coverage of 4 $g/m^2$ on a dry basis. Separately, a coating liquid for a resin layer having the following composition was coated onto a 25 μm-thick polyethylene terephthalate film ("Lumirror," manufactured by Toray Industries, Inc.) as a support to provide a resin layer at a coverage of 1 $g/m^2$ on a dry basis. The polyethylene terephthalate film provided with a receptive layer was applied to top of the support provided with a resin layer by dry lamination so that the surface of the transparent substrate remote from the receptive layer faced the resin layer on the support. Thereafter, in the same manner as in Example 1, the transparent sheet portion including the receptive layer was subjected to half cutting, and the transparent sheet portion including the receptive layer except for the image forming portion was separated and removed using the half cut portion as a boundary between the removal portion and the image forming portion remaining unresolved, followed by continuous winding to form a roll. Thus, an intermediate transfer recording medium of Comparative Example B5 was prepared.

| Composition of coating liquid for resin layer | |
|---|---|
| Addition polymerization-type silicone pressure-sensitive adhesive (X40-3002, manufactured by The Shin-Etsu Chemical Co., Ltd.) | 100 parts |
| Catalyst (CAT-PL-50T, manufactured by The Shin-Etsu Chemical Co., Ltd.) | 0.5 part |
| Methyl ethyl ketone/toluene (weight ratio = 1/1) | 400 parts |

The intermediate transfer media prepared in the examples and comparative examples were evaluated for the following items.

(Peel Force)

For each of the intermediate transfer media, the peel force between the resin layer and the transparent substrate was measured with a Tension measuring device under conditions of load cell 1 kgf, load cell speed 100 mm/min, sample width 1 inch and peel angle 180 degrees. Conditions other than described above were the same as those specified in JIS Z 0237.

(Reliability from Thermal Transfer Sheet)

A thermal transfer sheet (manufactured by Dai Nippon Printing Co., Ltd.), wherein three color transfer layers for yellow, magenta, and cyan as dye layers had been provided in a face serial manner, and each of the intermediate transfer recording media prepared in the above examples and comparative examples were put on top of each other so that the color transfer layer faced the resin layer in its portion exposed by removing the transparent sheet provided with the receptive layer. Recording was then carried out by a thermal head of a thermal transfer printer from the backside of the thermal transfer sheet under conditions of application voltage 12.0 V, pulse width 16 msec, printing cycle 33.3 msec, and dot density 6 dots/line to examine the releasability of the resin layer from the thermal transfer sheet.

The results were evaluated according to the following criteria.

○: Good reliability

X: Poor reliability (Reliability from Card)

A thermal transfer sheet (manufactured by Dai Nippon Printing Co., Ltd.), wherein three color transfer layers for yellow, magenta, and cyan as dye layers had been provided in a face serial manner, and each of the intermediate transfer recording media prepared in the above examples and comparative examples were put on top of each other so that the color transfer layer faced the receptive layer in the transparent sheet. Recording was then carried out by a thermal head of a thermal transfer printer from the backside of the thermal transfer sheet under conditions of application voltage 12.0 V, pulse width 16 msec, printing cycle 33.3 msec, and dot density 6 dots/line. Thereafter, a vinyl chloride card was put on top of the intermediate transfer recording medium so that the vinyl chloride card faced the image recorded face, followed by the transfer of the transparent sheet provided with the image formed thereon by means of a heat roll onto the vinyl chloride card from the backside (support side) of the intermediate transfer recording medium under conditions of temperature 130° C., speed 1 m/min, and pressure 3 kg/line to examine the peeling noise generated at the time of the separation of the transparent sheet from the support.

The results were evaluated according to the following criteria.

○: The transparent sheet could be smoothly separated from the support without causing significant peeling noise.

X: At the time of the separation of the transparent sheet from the support, large peeling noise occurred, and the reliability was failure.

(Overall Evaluation)

Based on all of the peel force, the reliability from the thermal transfer sheet, and the reliability from the card, the usefulness of the intermediate transfer medium was evaluated overall.

Evaluation criteria were as follows.

○: The intermediate transfer medium is highly useful.

Δ: The intermediate transfer medium is not useful and is unacceptable in some item.

X: The intermediate transfer medium is not useful and is unacceptable.

The results are shown in Table B1 below. In the following table, reliability 1 represents reliability from a thermal transfer sheet, and reliability 2 represents reliability from a card.

TABLE B1

| | Peel force | Releasability 1 | Releasability 2 | Others | Overall evaluation |
|---|---|---|---|---|---|
| Example B1 | 0.05 | ○ | ○ | — | ○ |
| Example B2 | 0.05 | ○ | ○ | — | ○ |
| Example B3 | 0.05 | ○ | ○ | — | ○ |
| Comparative Example B1 | Not separated | — | — | — | X |
| Comparative Example B2 | 0.07 | ○ | X | — | X |
| Comparative Example B3 | Not separated | — | — | — | X |
| Comparative Example B4 | 0.02 | X | X | — | X |
| Comparative Example B5 | 0.05 | ○ | X | (*) | Δ |

(*) The resin layer was tacky.
Peel force: N/inch

As described above, the intermediate transfer recording medium according to the present invention comprises: a support; and a transparent sheet stacked on the support through a resin layer, the transparent sheet comprising at least a transparent substrate and a receptive layer, the resin layer being separable from the transparent substrate, the resin layer comprising a polyallylate resin. According to this construction, the thermal transfer image formed on the receptive layer, together with the transparent substrate, is transferred onto an object, a strong protective layer constituted by the transparent substrate is formed on the image, and thus, the image can be made highly durable. Further, in the intermediate transfer recording medium according to the present invention, the protective layer can be transferred on the image in a highly accurate and simple manner. Furthermore, the reliability from the thermal transfer sheet at the time of image formation, and the reparability at the time of transfer onto the object are stable.

The presence of a polycondensate of 1,1-bis(4-hydroxyphenyl)-1-phenyl ethane as a biphenyl component with an aromatic dicarboxylic acid component as the polyallylate resin improves the glass transition temperature to enhance the heat resistance and, in addition, can increase the solubility in general-purpose solvents to eliminate the need to use or handle highly harmful solvents, such as chlorinated hydrocarbon solvents, for coating of the resin layer and to provide safe work environment.

The invention claimed is:

1. An intermediate transfer recording medium comprising:

a sheet substrate provided with a resin layer; and a transparent sheet provided with a receptive layer, said transparent sheet provided with the receptive layer having been superposed on top of the sheet substrate provided with the resin layer so that the resin layer faces the transparent sheet on its side remote from the receptive layer, the resin layer being separable from the transparent sheet to transfer the transparent sheet provided with the receptive layer onto an object, said resin layer having a two-layer structure of a first resin layer and a second resin layer provided in that order from the transparent sheet side, and the first resin layer is composed mainly of an acrylic resin and the second resin layer is an adhesive layer, the second resin layer being formed of a polyolefin resin formed on the transparent sheet by extrusion coating.

2. The intermediate transfer recording medium according to wherein the polyolefin resin is low density polyethylene.

3. The intermediate transfer recording medium according to claim 1, wherein the polyolefin resin is medium density polyethylene.

4. The intermediate transfer recording medium according to claim 1, wherein the resin layer has a three-layer structure of a first resin layer, a second resin layer, and a third resin layer provided in that order.

5. The intermediate transfer recording medium according to claim 1, wherein the transparent sheet portion including the receptive layer has been half cut.

6. The intermediate transfer recording medium according to claim 5, wherein the transparent sheet including the receptive layer in its half cut portion, on which no image is to be formed, has been previously removed.

7. A printing method comprising the step of, in using the intermediate transfer recording medium according to any claim 1, printing an image in an area larger than a patch portion as the image forming portion.

8. An intermediate transfer recording medium comprising:

a support;

and a transparent sheet stacked on the support through a resin layer, said transparent sheet comprising at least a transparent substrate and a receptive layer, the resin layer being separable from the transparent substrate, the resin layer comprising a polyallylate resin.

9. The intermediate transfer recording medium according to claim 8, wherein the polyallylate resin comprises a polycondensate of a bisphenol component of 1,1-bis(4-hydroxyphenyl)-1-phenylethane with an aromatic dicarboxylic acid component.

10. The intermediate transfer recording medium according to claim 8, which further comprises an intermediate layer provided between the support and the resin layer.

11. The intermediate transfer recording medium according to claim 8, wherein the peel force between the resin layer and the transparent substrate is 0.01 to 0.5 N/inch.

12. The intermediate transfer recording medium according to claim 8, wherein the peel force between the resin layer and the transparent substrate is 0.03 to 0.2 N/inch.

13. The intermediate transfer recording medium according to claim 8, wherein the resin layer further comprises a filler.

14. The intermediate transfer recording medium according to claim 8, wherein the transparent sheet portion comprising at least the transparent substrate and the receptive layer has been half cut.

* * * * *